US008038546B2

(12) United States Patent
Yokota

(10) Patent No.: US 8,038,546 B2
(45) Date of Patent: Oct. 18, 2011

(54) WOOD-TYPE GOLF CLUB HEAD

(75) Inventor: Masatoshi Yokota, Kobe (JP)

(73) Assignee: SRI Sports Limited, Kobe (JP)

( * ) Notice: Subject to any disclaimer, the term of this patent is extended or adjusted under 35 U.S.C. 154(b) by 149 days.

(21) Appl. No.: 12/490,056

(22) Filed: Jun. 23, 2009

(65) Prior Publication Data

US 2010/0022328 A1 Jan. 28, 2010

(30) Foreign Application Priority Data

Jul. 28, 2008 (JP) ..... 2008-193805

(51) Int. Cl.
*A63B 53/04* (2006.01)

(52) U.S. Cl. ..... 473/346

(58) Field of Classification Search ..... 473/324–350
See application file for complete search history.

(56) References Cited

U.S. PATENT DOCUMENTS

| | | | | |
|---|---|---|---|---|
| 5,028,049 | A * | 7/1991 | McKeighen | 473/345 |
| 5,131,986 | A * | 7/1992 | Harada et al. | 205/67 |
| RE34,925 | E * | 5/1995 | McKeighen | 473/305 |
| 5,501,459 | A * | 3/1996 | Endo | 473/346 |
| 6,048,278 | A * | 4/2000 | Meyer et al. | 473/345 |
| 6,074,310 | A * | 6/2000 | Ota | 473/345 |
| 6,162,133 | A * | 12/2000 | Peterson | 473/345 |
| 6,193,614 | B1 * | 2/2001 | Sasamoto et al. | 473/329 |
| 6,254,494 | B1 * | 7/2001 | Hasebe et al. | 473/349 |
| 6,325,728 | B1 * | 12/2001 | Helmstetter et al. | 473/328 |
| 6,339,869 | B1 * | 1/2002 | Peterson | 29/527.5 |
| 6,402,637 | B1 * | 6/2002 | Sasamoto et al. | 473/324 |
| 6,425,832 | B2 * | 7/2002 | Cackett et al. | 473/345 |
| 6,458,043 | B1 * | 10/2002 | McCabe et al. | 473/330 |
| 6,508,722 | B1 * | 1/2003 | McCabe et al. | 473/330 |
| 6,719,645 | B2 * | 4/2004 | Kouno | 473/345 |
| 6,783,465 | B2 * | 8/2004 | Matsunaga | 473/329 |
| 6,789,304 | B2 * | 9/2004 | Kouno | 29/527.5 |
| 6,832,961 | B2 * | 12/2004 | Sano | 473/324 |
| 6,852,038 | B2 * | 2/2005 | Yabu | 473/224 |
| 6,875,130 | B2 * | 4/2005 | Nishio | 473/345 |
| 6,929,566 | B2 * | 8/2005 | Sano | 473/349 |
| 7,070,512 | B2 * | 7/2006 | Nishio | 473/319 |
| 7,137,905 | B2 * | 11/2006 | Kohno | 473/314 |
| 7,278,925 | B2 * | 10/2007 | Oyama | 473/329 |
| 7,303,488 | B2 * | 12/2007 | Kakiuchi et al. | 473/346 |
| 7,431,668 | B2 * | 10/2008 | Tateno et al. | 473/346 |

(Continued)

FOREIGN PATENT DOCUMENTS

JP 08243194 A * 9/1996

(Continued)

*Primary Examiner* — Alvin Hunter
(74) *Attorney, Agent, or Firm* — Birch, Stewart, Kolasch & Birch, LLP

(57) ABSTRACT

A hollow wood-type golf club head 1 capable of controlling the spring effect without excessively increasing the weight of a face portion, the club head 1 comprising a face portion 3 having a face 2 for hitting a golf ball, a sole portion 5 constituting the bottom of the club head, and a junction 8 interconnecting the face portion and the sole portion and including at least one thick wall portion 9 having a thickness t2 larger than a thickness t1 at a lower edge of the face portion 3 and having a length L of 20 mm or more wherein the length L is a total of lengths in a toe-heel direction of said at least one thick wall portion 9.

17 Claims, 7 Drawing Sheets

U.S. PATENT DOCUMENTS

| | | | | |
|---|---|---|---|---|
| 7,435,191 | B2 * | 10/2008 | Tateno et al. | 473/346 |
| 7,462,109 | B2 * | 12/2008 | Erickson et al. | 473/332 |
| 7,559,853 | B2 * | 7/2009 | Hirano | 473/324 |
| 7,585,233 | B2 * | 9/2009 | Horacek et al. | 473/345 |
| 7,611,424 | B2 * | 11/2009 | Nagai et al. | 473/334 |
| 7,699,719 | B2 * | 4/2010 | Sugimoto | 473/345 |
| 7,798,916 | B2 * | 9/2010 | Matsunaga et al. | 473/329 |
| 2007/0275792 | A1 | 11/2007 | Horacek et al. | |

FOREIGN PATENT DOCUMENTS

| | | | |
|---|---|---|---|
| JP | 2000116823 | A * | 4/2000 |
| JP | 2004057645 | A * | 2/2004 |
| JP | 2007037921 | A * | 2/2007 |
| JP | 2008142403 | A * | 6/2008 |
| JP | 2010029379 | A * | 2/2010 |

* cited by examiner

WOOD-TYPE GOLF CLUB HEAD

BACKGROUND OF THE INVENTION

The present invention relates to a wood-type golf club head having a hollow interior, and more particularly a hollow wood-type golf club head having a spring effect suppressed without excessively increasing the weight of a face portion of the club head.

It has been recently set in golf rules that the design, material and/or construction of, or any treatment to, the club head must not have the effect of a spring which exceeds the limit set forth in the Pendulum Test Protocol on file with the R&A (upper limit: 239 μs+error of 18 μs). Simply put, the spring effect is an ability of a club face which depresses and then springs back into shape, when striking a ball, to act as a spring or trampoline, adding extra oomph to a shot.

However, in case that a large-sized hollow golf club head is formed from a metallic material having a high specific strength, the club head tends to have a spring effect which exceeds the limit set forth in the golf rules. Therefore, in order to produce golf club heads which meet the golf rules, it may be required hereinafter to further lower the spring effect.

The smaller the rigidity of a face portion of a club head, the larger the spring effect. Specifically, the smaller the thickness of the face portion or the smaller the Young's modulus of a metallic material constituting the face portion, the larger the spring effect of the club head tends to become. Therefore, assuming the use of metallic materials conventionally used for golf club heads, it is required for lowering the spring effect to increase the thickness of the face portion and to decrease the flexure of the face portion at ball striking. However, if the face portion is made thick, a margin of weight capable of using in weight distribution design of club heads is decreased, so the degree of freedom in design about position of the club head's center of gravity is decreased. Therefore, it is desired to lower the spring effect without increasing the thickness of face portion.

US 2007/0275792 A1 proposes disposing at least one stiffening member such as a mass member or a rib at a junction interconnecting a sole, a crown and a skirt to a striking face, thereby allowing a reduction in thickness of the striking face while maintaining a maximum coefficient of restitution of 0.830 or less per USGA rules.

It is an object of the present invention to provide a wood-type golf club head capable of easily controlling the spring effect within a range provided in the R&A rules without excessively increasing the weight of a face portion of the club head.

This and other objects of the present invention will become apparent from the description hereinafter.

SUMMARY OF THE INVENTION

In accordance with the present invention, there is provided a hollow wood-type golf club head comprising a face portion having a hitting face for hitting a golf ball, a sole portion constituting the bottom of the club head, and a junction interconnecting the face portion and the sole portion and including one or more thick wall portions, said one or more thick wall portions having a thickness larger than a thickness at a lower edge of the face portion and having a length L of 20 mm or more wherein the length L is a total of lengths in a toe-heel direction of said one or more thick wall portions disposed in the club head.

A single thick wall portion may be disposed at the junction, or a plurality of thick wall portions may be disposed at intervals at the junction.

Preferably, the thickness of the thick wall portion is larger than that of the lower edge of the face portion by at least 0.5 mm.

In a standard state that the club head is placed on a horizontal plane at prescribed lie and loft angles, the thick wall portion is preferably disposed so as to extend across a vertical plane including the head's center of gravity and the sweet spot.

It is important in suppressing the spring effect of a club head that the flexure of a face portion at the time of hitting a ball is as small as possible. The wood-type golf club head of the present invention includes one or more thick wall portions at a junction interconnecting the face portion and the sole portion, wherein the thick wall portions have a thickness larger than that of a lower edge of the face portion and a total length of the thick wall portions in a toe-heel direction of the club head is regulated within a specific range. Such thick wall portion or portions can enhance the rigidity of a lower part of the face portion without excessively increasing the weight of the face portion, thus suppressing the flexure of the face portion. Therefore, according to the present invention, the spring effect can be reduced to meet the golf rules without large increase in weight of the face portion.

DETAILED DESCRIPTION

An embodiment of the present invention will be explained below with reference to the accompanying drawings.

Figure 1:
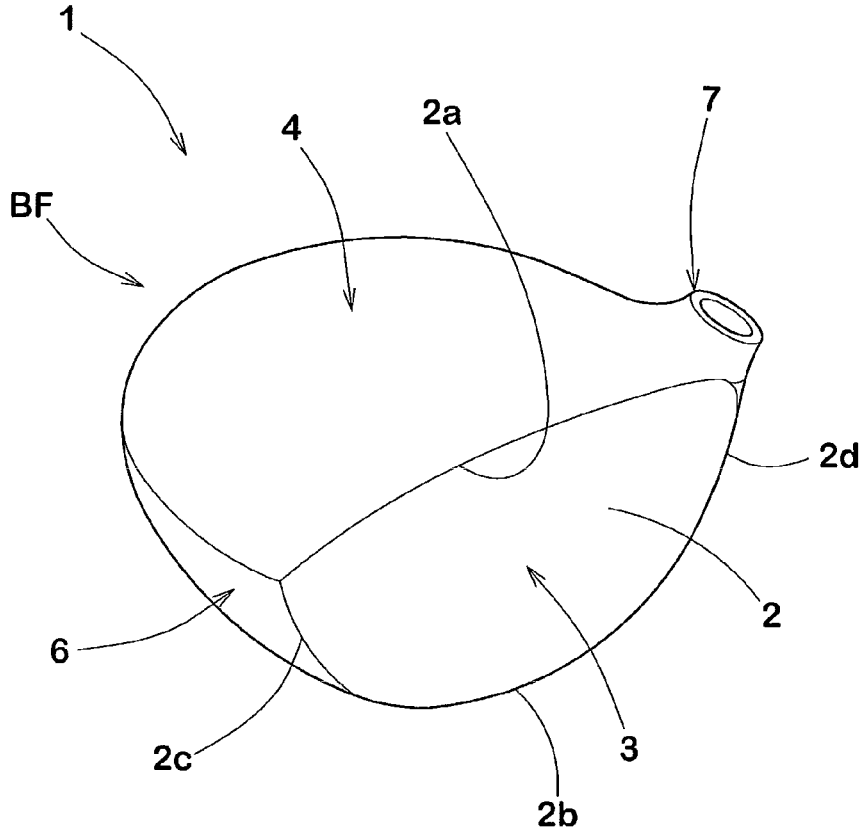
FIG. 1 is a perspective view of a golf club head showing an embodiment of the present invention.
Figure 2:
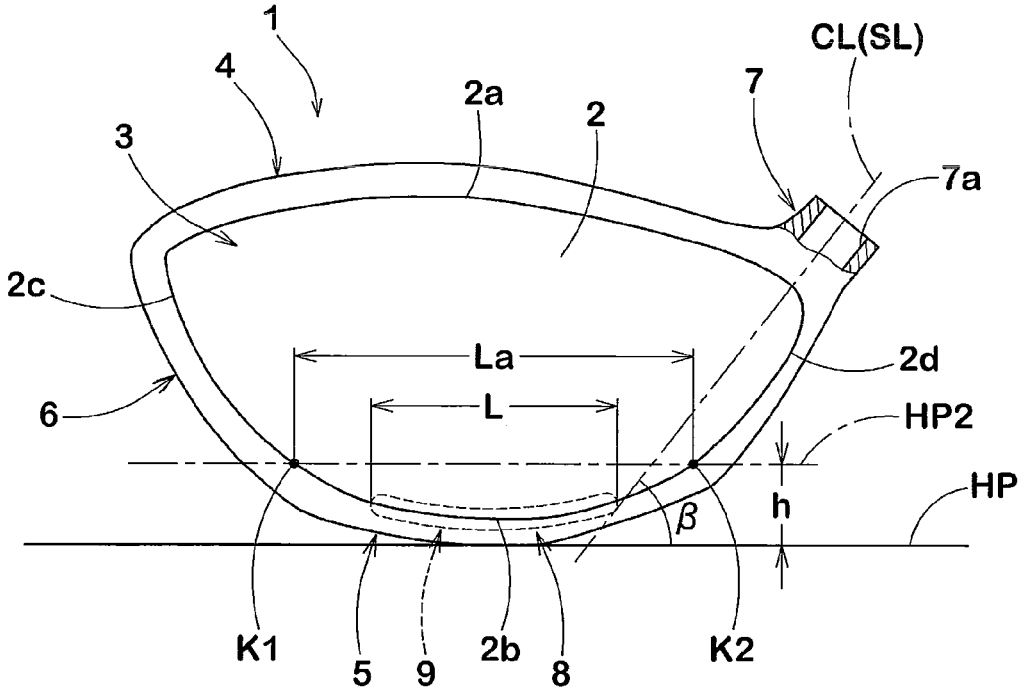
FIG. 2 is a front view of the club head of FIG. 1.
Figure 3:
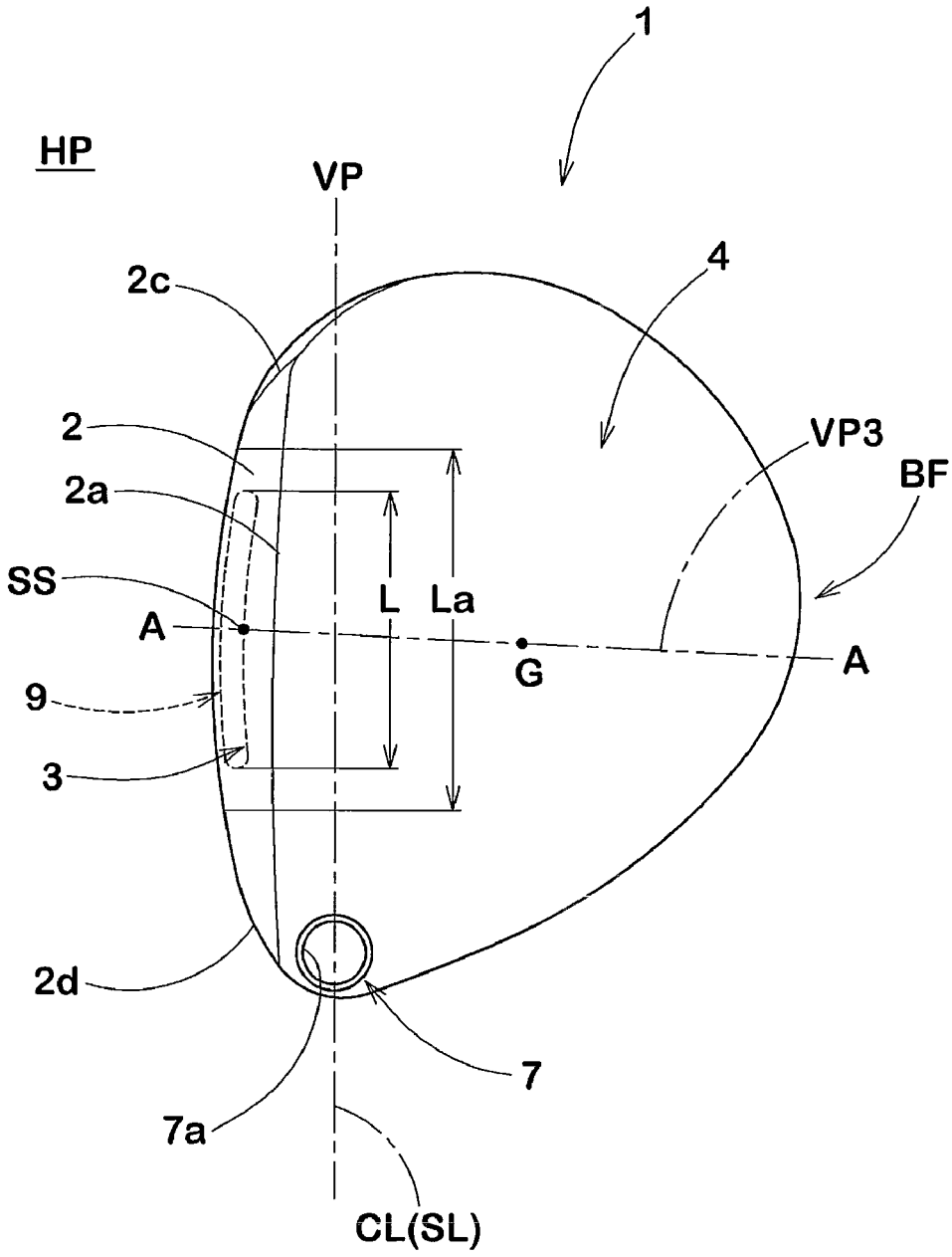
FIG. 3 is a plan view of the club head of FIG. 1.

FIGS. 1 to 4 are perspective, front and plane views of a wood-type golf club head 1 in the standard state according to an embodiment of the present invention, and an end view along the line A-A of FIG. 3, respectively.

Figure 4:
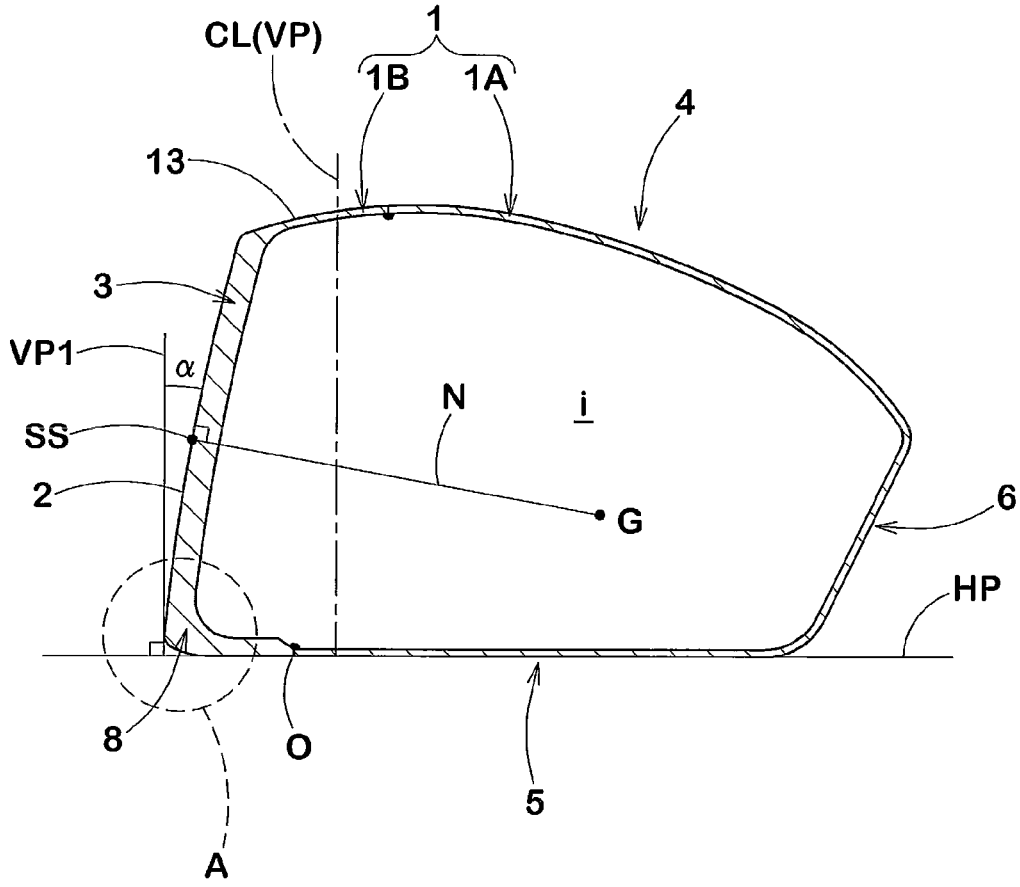
FIG. 4 is an end view along the line A-A of FIG. 3.

The term "standard state" of a golf club head as used herein denotes the state that, as shown in FIGS. 2 to 4, golf club head 1 is placed on a horizontal plane HP in the state that an axial center line SL of a shaft is disposed in an optional vertical plane VP and is inclined at a prescribed lie angle β with respect to the horizontal plane HP, and a hitting face 2 is inclined at a prescribed loft angle α (real loft angle, hereinafter the same) given to the club head 1 with respect to a vertical plane VP1 parallel to the vertical plane VP. The head 1 referred to herein is in the standard state unless otherwise noted.

The club head 1 is formed into a wood-type club head having a hollow structure that a hollow portion "i" is formed inside the club head, as shown in FIG. 4. The term "wood-type golf club head" as used herein does not mean that the head is made of a woody material, but means golf club heads having a so-called wood-type head shape, e.g., driver (#1 wood), brassy (#2 wood), spoon (#3 wood), baffy (#4 wood) and cleek (#5 wood), and comprehends heads which are different from these heads in number or name, but have a shape approximately similar to these heads. In this embodiment is shown a driver head.

Preferably, the club head 1 of this embodiment has a head volume of at least 380 $cm^3$, especially at least 400 $cm^3$, more especially at least 420 $cm^3$. Such a large head volume is useful for increasing the moment of inertia or the depth of the center of gravity of the club head 1. On the other hand, if the volume of the club head 1 is too large, problems may arise, e.g., increase of head weight, deterioration of swing balance and violation of golf rules. Therefore, it is preferable that the volume of club head 1 is at most 500 $cm^3$, especially at most 470 $cm^3$, more especially at most 460 $cm^3$.

Further, it is preferable that the whole weight of club head 1 is at least 180 g, especially at least 185 g, and it is at most 220 g, especially at most 215 g. If the weight is too small, the swing tends to be not stabilized since a player is hard to feel the weight of the head during swing. Further, the repulsion property tends to lower. If the weight of the club head is too large, it is difficult to follow through a golf club, so the flight distance and directionality of a hit ball tend to deteriorate.

The golf club head 1 in this embodiment includes a face portion 3 having a face 2 for hitting a golf ball on its front side, a crown portion 4 forming the upper surface of the head 1, a sole portion 5 forming the bottom surface of the head 1, a side portion 6 which extends between the crown portion 4 and the sole portion 5 from a toe side edge 2*c* of the face 2 to a heel side edge 2*d* of the face 2 through a back face BF (a face facing the opposite side of the face 2) of the head 1, and a hosel portion 7 which is disposed on a heel side of the crown portion 4 and has a shaft inserting hole 7*a* to attach a shaft (not shown). In case that no shaft is attached to the club head 1, an axial center line CL of the shaft inserting hole 7*a* is used instead of an axial center line SL of the shaft.

The club head 1 in this embodiment comprises, as shown in FIG. 4, a head body 1A having an opening O on its front side, and a face member 1B attached to the opening O.

The face member 1B in this embodiment is formed into an approximately cup-shaped body in which the face portion 3 and an extension 13 which extends toward the rear of the head 1 from peripheral edges 2*a*, 2*b*, 2*c* and 2*d* of the face 2 to provide respective front parts of the crown portion 4, sole portion 5 and side portion 6, are integrally formed. Of course, the face member 1B may be in the form of a plate which can be fit in the face portion 3.

The head body 1A and the face member 1B can be produced by a known method, e.g., casting, forging or pressing. The club head 1 is produced by welding them in a known manner.

The head body 1A and the face member 1B are produced from one or more kinds of metallic materials. Preferable examples of the metallic materials are, for instance, a stainless steel, a marageing steel, titanium, a titanium alloy, an aluminum allow, a magnesium alloy, an amorphous alloy, and combinations of these metals. Further, although not shown in the drawings, non-metallic materials having a lower specific gravity such as fiber-reinforced resins may be used in a part of the head body 1A, or one or more weight members having a larger specific gravity may be fixed to the head body 1A, whereby the center of gravity G can be adjusted to an optimum location.

Figure 5:
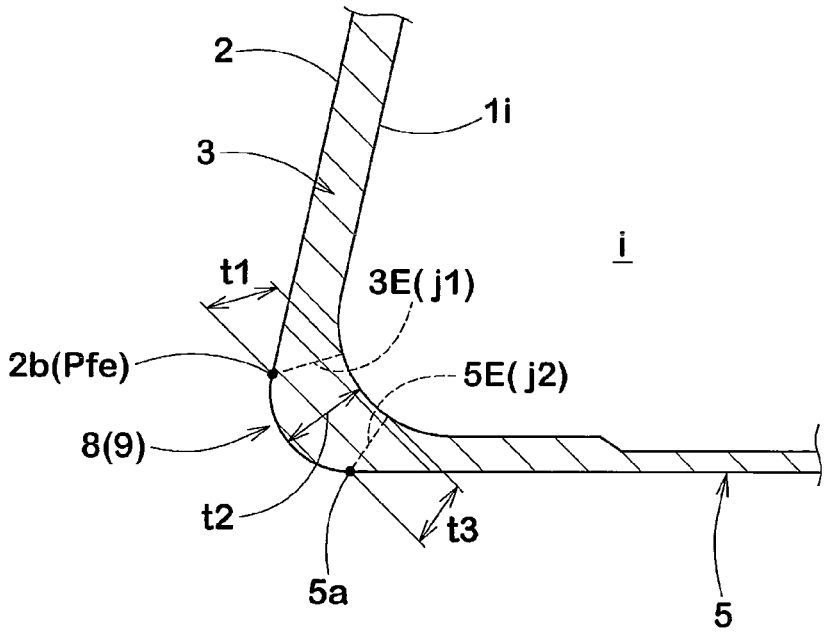
FIG. 5 is a partially enlarged view showing a portion A in FIG. 4.

The club head 1 of the present invention is provided with a junction 8 connecting the face portion 3 to the sole portion 5. Portion A of FIG. 4 is shown in FIG. 5 in an enlarged manner. As shown in FIG. 5, the junction 8 connects a lower edge 3E of the face portion 3 and a front edge 5E of the sole portion 5 to each other.

The term "face portion" as used herein denotes a portion having the face 2 on its front surface. Further, the term "face" as used herein denotes a hitting face surrounded by a face perimeter edge, i.e., an upper edge 2*a* on a crown portion 4 side, a lower edge 2*b* on a sole portion 5 side, a toe side edge 2*c* and a heel side edge 2*d*, as shown in FIG. 2.

Figure 6A:
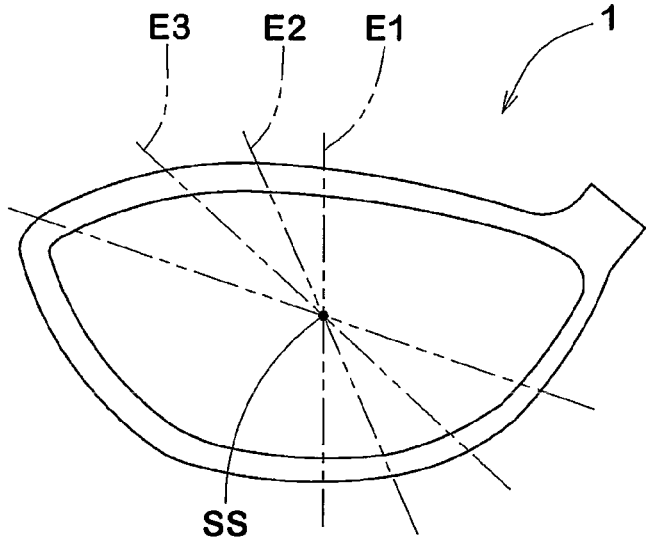
FIG. 6A is a front view illustrating a peripheral edge of the face and FIG. 6B is a cross sectional view along the line E1 of FIG. 6A.

In the case that the edges 2*a* to 2*d* of the face 2 forms a visible clear ridge line, this ridge line denotes the face perimeter edge. However, in the case that the face edges 2*a* to 2*d* are not clear, they are determined as follows:

Firstly, as shown in FIG. 6A, the club head 1 is cut by a large number of planes E1, E2, E3 . . . En passing through a normal line N drawn to the face 2 from the center of gravity G of the head 1 (cf. FIG. 4, a point where the normal line N intersects the face 2 being called sweet spot SS), thereby obtaining cross sectional shapes.

Figure 6B:
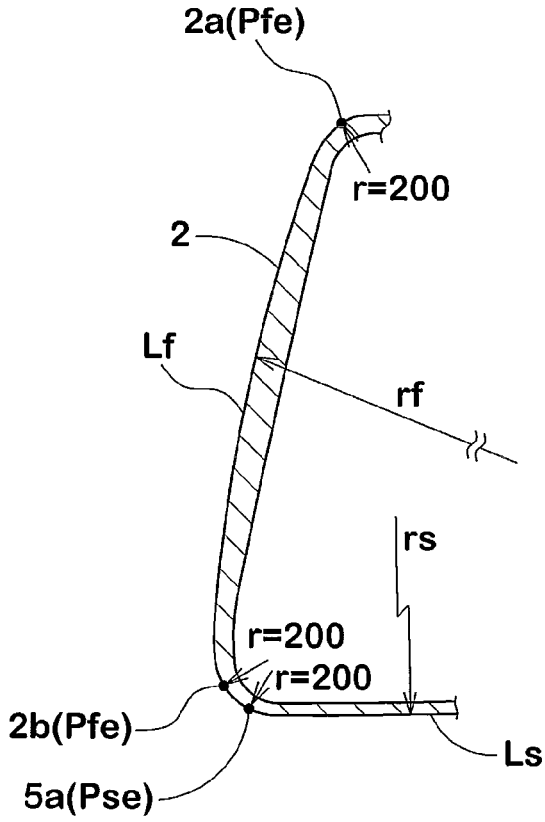

Then, as shown in FIG. 6B, in each section, positions Pfe at which the radius of curvature "rf" of an outer contour line Lf of the face 2, namely the vertical roll radius "rf" of the exterior surface of the face 2, reaches 200 mm first when measured from the sweet spot side, are defined as points on the face perimeter edge (edges 2*a* to 2*d* of the face 2). In the case that the face has face lines or punch marks, they are filled for determination of the outer contour line Lf.

As shown in FIG. 5, in each section, an imaginary line j1 at which a distance t1 measured from the lower edge 2*b* of the face 2 toward an inner surface 1*i* of the head 1 is minimum, is defined as a lower edge 3E of the face portion 3.

Further, as shown in FIG. 6B, in each section, a position Pse at which the radius of curvature "rs" of an outer contour line Ls of the sole portion 5 reaches 200 mm first when measured from a sole center side toward the face side is defined as a point on a front edge 5*a* of a sole surface. As shown in FIG. 5, in each section, an imaginary line j2 at which a distance t3 measured from the front edge 5*a* of the sole surface toward the inner surface 1*i* of the head 1 is minimum, is defined as a front edge 5E of the sole portion 5. In the case that the sole portion 5 has a pattern or a logo mark, they are removed for determination of the outer contour line Ls.

In the present invention, as shown in FIG. 5, the junction 8 located between the lower edge 3E of the face portion 3 and the front edge 5E of the sole portion 5 includes at least one thick wall portion 9 having a thickness t2 larger than the thickness t1 at the lower edge 3E of the face portion 3. Length L, namely sum of lengths in a toe-heel direction of one or more thick wall portions 9 disposed in the club head, is set to 20 mm or more (cf. FIGS. 2 and 3).

It is important in suppressing the flexure of club head 1 to decrease the spring effect at impact of the face portion 3. In the club head 1 of the present invention, a rigidity on a lower edge 3E side of the face portion 3 is enhanced by the thick wall portion 9, so the flexure at impact of the face portion 3 is suppressed. Therefore, the club head 1 of the present invention can decrease the spring effect to meet the golf rules without increasing the thickness or the like of the face portion 3. Further, the thick wall portion 9 is helpful for achieving a low center of gravity and for enhancing the durability of the face portion 3 and the sole portion 5. In particular, as a result of suppression of the spring effect by the thick wall portion 9, there is exhibited an effect that the durability of the whole head, particularly a peripheral portion of the face portion 3, is enhanced.

Figure 7A:
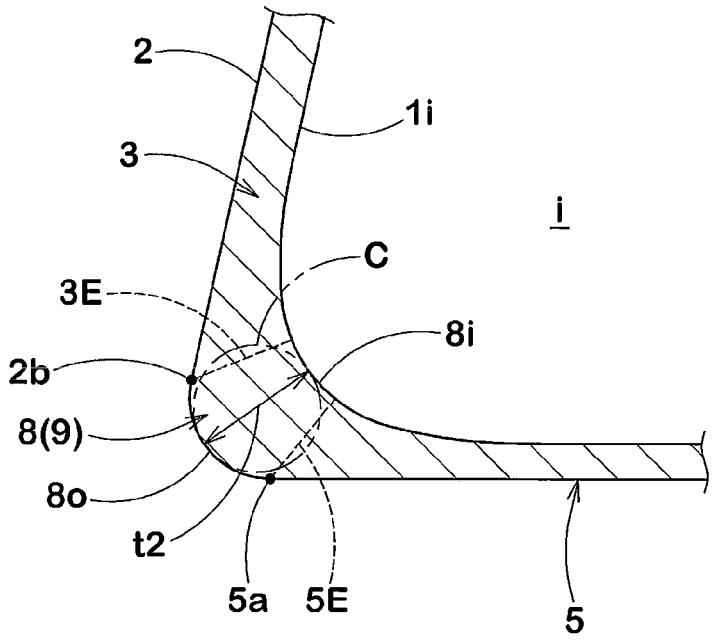
FIGS. 7A and 7B are enlarged cross sectional views showing a junction.
Figure 7B:
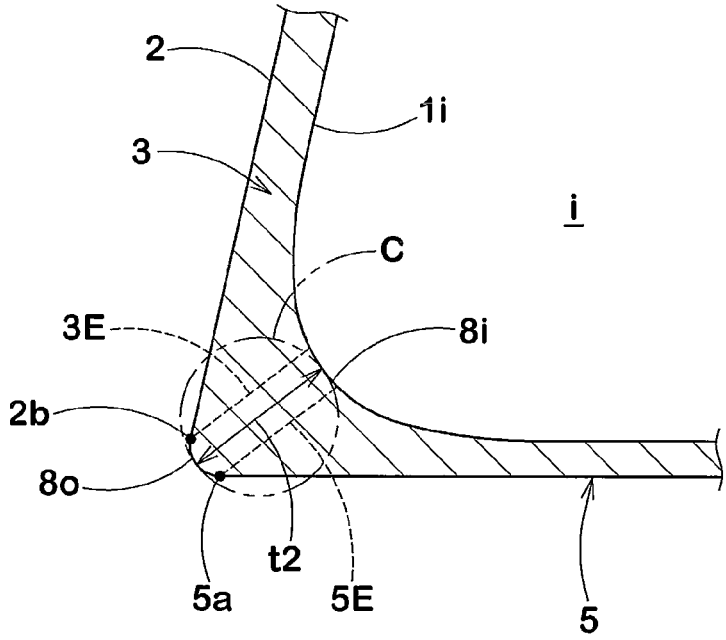

As shown in FIGS. 7A and 7B which are enlarged partial cross sectional views of the club head 1 along the line E1 of FIG. 6A, the thickness t2 of the junction 8 is obtained as a diameter of an imaginary circle C which comes into contact with both outer surface 8*o* and inner surface 8*i* of the junction 8 and has the largest area among such circles contacting the outer and inner surfaces 8*o* and 8*i*. The imaginary circle C may be inscribed with the outer surface 8*o* of the junction 8 as shown in FIG. 7A, or may be circumscribed with the outer surface 8*o* of the junction 8 as shown in FIG. 7B.

Figure 8A:
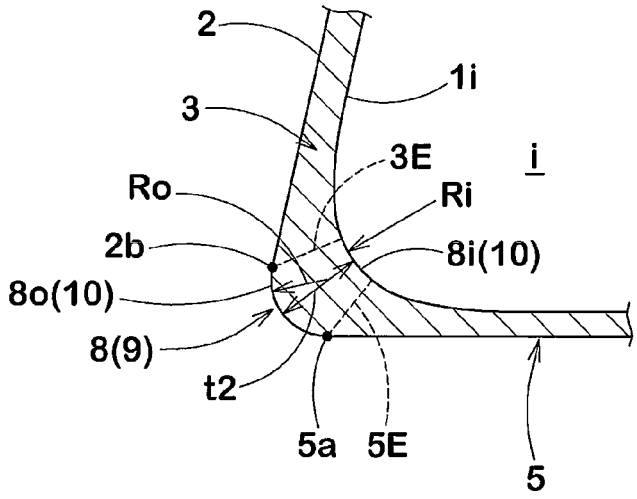
FIGS. 8A to 8C are cross sectional views illustrating various cross section shapes of a thick wall portion.
Figure 8B:
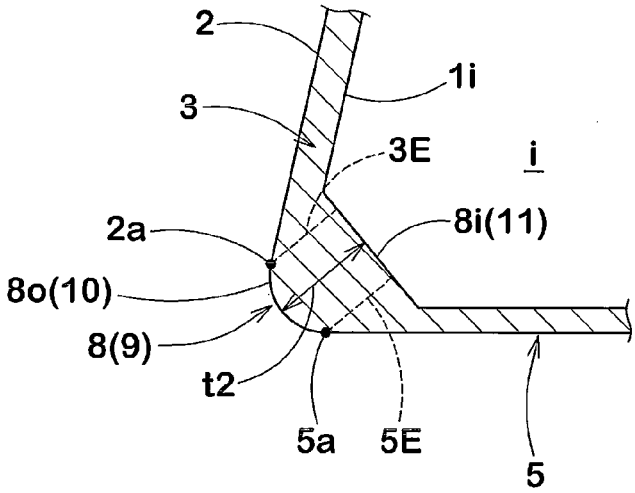
Figure 8C:
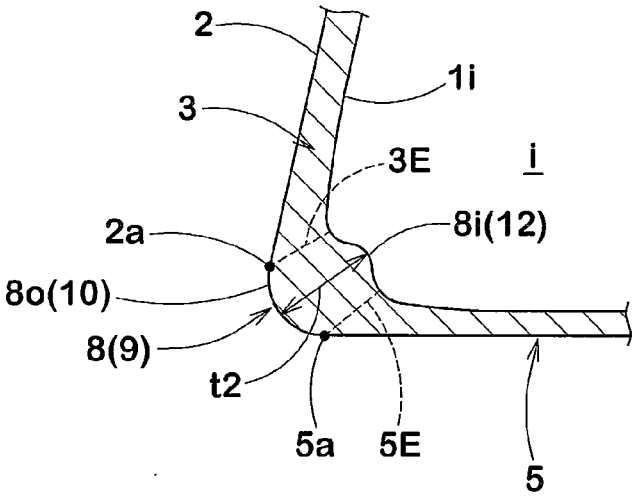

Examples of the sectional shape of the thick wall portion 9 are shown in FIGS. 8A to 8C.

The thick wall portion 9 of FIG. 8A has such a sectional shape that the outer and inner surfaces 8*o* and 8*i* of the junction 8 are formed into arc surfaces 10 convex toward outward of the club head 1, and the radius of curvature Ri of the inner arc surface 8*i*(10) is larger than the radius of curvature Ro of the outer arc surface 8*o*(10). If the radius of curvature ratio Ri/Ro is small, the effect of suppressing the spring effect tends to relatively lower, and if the ratio Ri/Ro is large, the inner arc surface 8*i* of the junction 8 is flattened and stress concentration may occur at both ends of the flattened inner surface 8*i*. From such points of view, the ratio Ri/Ro is preferably at least 1.2, more preferably at least 1.5, still more preferably at least 2.0, and it is preferably at most 20, more preferably at most 10, still more preferably at most 7.

The thick wall portion 9 of FIG. 8B has such a sectional shape that the outer surface 8*o* of the junction 8 is an arc surface 10 convex toward outward of the club head 1, and the inner surface 8*i* of the junction 8 is an inclined plane 11 which extends from the sole toward the crown and is inclined toward the face side. The thick wall portion 9 having such a cross sectional shape can greatly enhance the rigidity of the junction 8.

The thick wall portion 9 of FIG. 8C has such a sectional shape that the outer surface 8*o* of the junction 8 is an arc surface 10 convex toward outward of the club head 1, and the inner surface 8*i* of the junction 8 is an arc surface 12 convex toward inward of the club head 1.

The thick wall portion 9 can have one or more of various sectional shapes. However, the shapes of FIGS. 8A and 8B are suitable in effectively suppressing deformation at impact of the face portion 3 with minimum weight of the thick wall portion. Since stress concentration tends to occur at the both ends of the inclined flat surface 11 of FIG. 8B, a shape having an arc inner surface 8*i* such that the thick wall portion 9 is smoothly connected to both the face portion 3 and the sole portion 5, as shown in FIG. 8A, is the most suitable.

It is preferable that the thickness t2 of the thick wall portion 9 is at least 2.0 mm, especially at least 2.2 mm, more especially at least 2.5 mm, still more especially at least 3.0 mm. If the thickness t2 is less than 2.0 mm, there is a possibility that deformation at impact of the face portion 3 cannot be sufficiently suppressed. Further, if the thickness t2 is too large, there is a possibility that the weight of that portion becomes large, so the degree of freedom in weight distribution design is impaired. Therefore, it is preferable that the thickness t2 of the thick wall portion 9 is at most 8.0 mm, especially at most 7.0 mm, more especially at most 6.5 mm.

On the other hand, it is preferable that the thickness t1 at the lower edge 3E of the face portion 3 is at least 1.5 mm, especially at least 1.8 mm, more especially at least 2.0 mm, and it is at most 4.5 mm, especially at most 4.2 mm, more especially at most 4.0 mm. If the thickness t1 is too small, the durability of the face portion 3 tends to deteriorate, and if the thickness t1 is too large, there is a possibility that the weight of the face portion 3 becomes large, so the degree of freedom in weight distribution design is impaired.

From the same points of view, it is preferable that the thickness t3 at the front edge 5E of the sole portion 5 is at least 1.5 mm, especially at least 1.6 mm, more especially at least 1.7 mm, and it is at most 4.0 mm, especially at most 3.5 mm, more especially at most 3.0 mm.

It is preferable that the thickness t2 of the thick wall portion 9 is larger than the thickness t1 at the lower edge 3E of the face portion 3 by at least 0.5 mm, especially at least 0.8 mm, more especially at least 1.0 mm. If the difference t2−t1 in thickness is less than 0.5 mm, there is a possibility that the effect of enhancing the rigidity of a lower edge portion of the face portion 3 is insufficient, so deformation at impact of the face portion 3 is not sufficiently suppressed.

Further, it is preferable that a ratio t1/t2 of the thickness t1 at the lower edge 3E of the face portion 3 to the thickness t2 of the thick wall portion 9 is at least 0.30, especially at least 0.50, more especially at least 0.70. If the ratio t1/t2 is less than 0.30, the durability of the face portion 3 may be deteriorated since the thickness t1 at the lower edge 3E of the face portion 3 is relatively small, and increase in weight of the club head 1 may occur since the thickness t2 of the thick wall portion 9 is relatively large. In contrast, if the ratio t1/t2 is too large, there is a possibility that deformation at impact of the face portion 3 is not sufficiently suppressed. Therefore, it is preferable that the ratio t1/t2 is at most 0.95, especially at most 0.90, more especially at most 0.80.

Similarly, it is preferable that a ratio t3/t2 of the thickness t3 at the front edge SE of the sole portion 5 to the thickness t2 of the thick wall portion 9 is at least 0.10, especially at least 0.20, more especially at least 0.30. If the ratio t3/t2 is less than 0.10, the durability of a front edge portion of the sole portion 5 may be deteriorated since the thickness t3 at the front edge SE of the sole portion 5 is relatively small, and increase in weight of the club head 1 may occur since the thickness t2 of the thick wall portion 9 is relatively large. Further, it is preferable that the ratio t3/t2 is at most 0.90, especially at most 0.70, more especially at most 0.50.

In the embodiment shown in FIGS. 2 and 3, only one thick wall portion 9 is formed. The length L in the toe-heel direction of the thick wall portion 9 is at least 20 mm. If the length L of the thick wall portion 9 is less than 20 mm, deformation at impact of the face portion 3 cannot be sufficiently suppressed by only the thick wall portion 9. The length L is preferably at least 25 mm, more preferably at least 30 mm.

The term "length L" in the toe-heel direction of the thick wall portion 9 denotes a length along the vertical plane VP when the thick wall portion 9 is viewed from above (when viewed in the plane view of FIG. 3).

The upper limit of the length L of the thick wall portion 9 is not particularly limited. Therefore, the length L may be identical to the whole length La of the junction 8 located between the lower edge 3E of the face portion 3 and the front edge 5E of the sole portion 5. However, as the length L of the thick wall portion 9 approaches the whole length La of the junction 8, the effect of lowering the spring effect approaches a plateau and, moreover, the weight of the club head tends to become excessively large. Therefore, it is preferable to select the length L so that a ratio L/La is at most 0.90, especially at most 0.70, more especially at most 0.50. On the other hand, if the ratio L/La is excessively small, a stress is easy to concentrate on a neighborhood of the thick wall portion 9 when hitting a ball. Therefore, the ratio L/La is preferably at least 0.10, more preferably at least 0.15.

The term "whole length La" of the junction 8 denotes a distance between intersecting points K1 and K2 at which a second horizontal plane HP2 passing a location with a height "h" of 10 mm from the horizontal plane HP intersects the face perimeter edge, i.e. edges 2*a* to 2*d* of the face 2, as shown in FIG. 2 (in other words, a length in the toe-heel direction of a junction between the points K1 and K2 measured along the vertical plane VP when viewed in the plane view of FIG. 3).

A plurality of the thick wall portions can be disposed at intervals in the junction 8. In embodiments shown in FIGS. 9B and 9C, two or three thick wall portions 9*a*, 9*b* and 9*c* are disposed. The total length L of the thick wall portions, namely sum of respective lengths L1, L2 . . . Ln of thick wall portions 9*a*, 9*b* . . . , is at least 20 mm. Like this, the thick wall portion 9 can be disposed in the club head in various configurations. In case of disposing a plurality of thick wall portions 9, a stress is easy to concentrate on a neighborhood of the thick wall portions 9 when hitting a ball if a ratio Li/La of a length Li of each thick wall portion to the whole length La of the junction 8 is small. Therefore, the ratio Li/La is preferably at least 0.10, more preferably at least 0.15, still more preferably at least 0.25. For the same reason, the length Li in the toe-heel direction of each of the thick wall portions 9 is preferably at least 10 mm, more preferably at least 15 mm, still more preferably at least 17.5 mm.

Figure 9A:
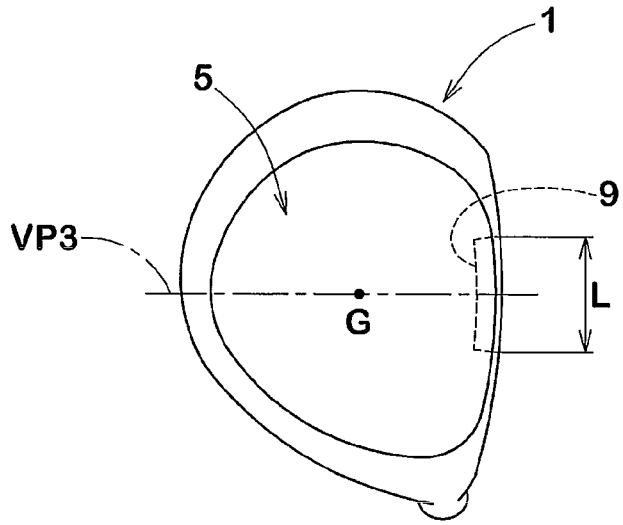
FIGS. 9A to 9C are horizontal sectional views illustrating arrangement of one or more thick wall portions in a toe-heel direction of the club head.
Figure 9B:
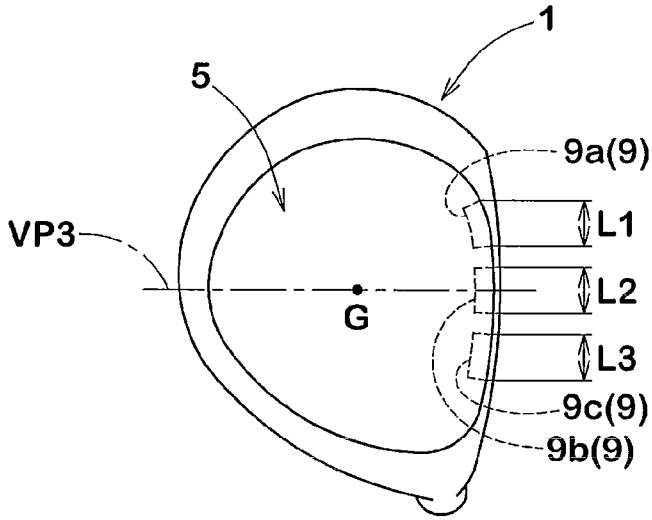
Figure 9C:
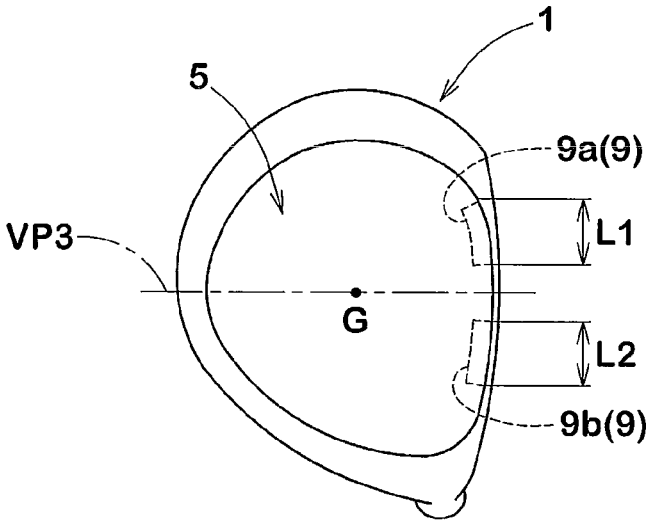

As shown in FIGS. 9A and 9B, it is preferable that in the standard state, at least one thick wall portion 9 is disposed so as to extend across a vertical plane VP3 including the head's center of gravity G and the sweet spot SS. When the thick wall portion 9 is disposed at such a location, flexure at impact of a neighborhood of the sweet spot SS of the face portion 3 can be effectively suppressed by less weight. It is particularly preferable that the thickness t2 of the thick wall portion or portions 9 is the largest at the location of vertical plane VP3 and is smaller on toe and heel sides.

While preferable embodiments of the present invention have been described with reference to the drawings, it goes without saying that the present invention is not limited to only such embodiments and various changes and modifications may be made.

The present invention is more specifically described and explained by means of the following Examples and Comparative Examples. It is to be understood that the present invention is not limited to these Examples.

EXAMPLES 1 TO 8 AND COMPARATIVE EXAMPLES 1 AND 2

Wood-type golf club heads having a head volume of 460 $cm^3$, a real loft angle of 10° and a lie angle of 7.5° were prepared according to the specifications shown in Table 1, and tests of spring effect and durability were made. Each of the club heads was prepared from Ti-6A1-4V alloy by integrally forming a head body by a lost-wax precision casing method, press forming a rolled material into an approximately cup-like face member and then plasma-welding them. Specifications of all portions excepting a junction were common to all club heads. Thicknesses of respective portions were as follows:

Thickness of face portion at sweet spot SS: 3.2 mm
Average thickness of crown portion: 0.65 mm
Average thickness of sole portion: 1.43 mm
Average thickness of side portion: 0.7 mm The average thickness denotes an area-weighted average value.

The tests were made in the following manner.

<Spring Effect>

"Characteristic time" (CT) of each club head was measured according to the Pendulum Test Protocol of R&A. The CT value is a value (unit: μs) showing an efficiency at impact, and the larger the value, the higher the spring effect. The upper limit of the CT value provided by the golf rules is 239 μs (error of +18 μs being permissible).

<Durability>

The same FRP shafts (SV-3003J: flex X made by SRI Sports Limited) were attached to all club heads to be tested to give wood-type gold clubs having a full length of 45 inches. Each of the golf clubs was attached to a swing robot (made by Kabushiki Kaisha Miyamae), and struck up to 10,000 golf balls per club at a head speed of 54 m/s. Presence of damage of the club head at its face portion and a peripheral portion thereof was visually observed every 100 shots, and the number of shots up to generation of damage was measured.

The results of the tests are shown in Table 1.

TABLE 1

| | Ex. 1 | Ex. 2 | Ex. 3 | Ex. 4 | Ex. 5 |
|---|---|---|---|---|---|
| Thick wall portion(s) | | | | | |
| Sectional shape | FIG. 8A | FIG. 8A | FIG. 8A | FIG. 8B | FIG. 8C |
| Thickness t2 (mm) | 4 | 4.5 | 5 | 4.5 | 4.5 |
| Arrangement | FIG. 9A | FIG. 9A | FIG. 9A | FIG. 9A | FIG. 9A |
| Number of thick wall portions | 1 | 1 | 1 | 1 | 1 |
| Length Li of each thick wall portion (mm) | 35 | 35 | 35 | 35 | 35 |
| Total length L (= ΣLi) (mm) | 35 | 35 | 35 | 35 | 35 |
| Thickness t1 at lower edge of face portion (mm) | 3.5 | 3.5 | 3.5 | 3.5 | 3.5 |
| Thickness t3 at front edge of sole portion (mm) | 1.8 | 1.8 | 1.8 | 1.8 | 1.8 |
| Whole length La of junction (mm) | 70 | 70 | 70 | 70 | 70 |
| Ratio t1/t2 | 0.88 | 0.78 | 0.70 | 0.78 | 0.78 |
| Ratio t3/t2 | 0.45 | 0.40 | 0.36 | 0.40 | 0.40 |
| Ratio L/La (=ΣLi/La) | 0.50 | 0.50 | 0.50 | 0.50 | 0.50 |
| Li/La | 0.50 | 0.50 | 0.50 | 0.50 | 0.50 |
| Spring effect: CT value (μs) | 255 | 250 | 243 | 246 | 252 |
| Durability: Number of shots up to damage | No damage | No damage | No damage | 8200* | 6900* |

| | Ex. 6 | Ex. 7 | Ex. 8 | Com. Ex. 1 | Com. Ex. 2 |
|---|---|---|---|---|---|
| Thick wall portion(s) | | | | None | |
| Sectional shape | FIG. 8A | FIG. 8A | FIG. 8A | — | FIG. 8A |
| Thickness t2 (mm) | 4.5 | 4.5 | 4.5 | 3.5 | 4.5 |
| Arrangement | FIG. 9B | FIG. 9C | FIG. 9A | — | FIG. 9A |

TABLE 1-continued

| | | | | | |
|---|---|---|---|---|---|
| Number of thick wall portions | 3 | 2 | 1 | — | 1 |
| Length Li of each thick wall portion (mm) | 11<br>13<br>11 | 17.5<br>17.5 | 20 | — | 15 |
| Total length L (= ΣLi) (mm) | 35 | 35 | 20 | — | 15 |
| Thickness t1 at lower edge of face portion (mm) | 3.5 | 3.5 | 3.5 | 3.5 | 3.5 |
| Thickness t3 at front edge of sole portion (mm) | 1.8 | 1.8 | 1.8 | 1.8 | 1.8 |
| Whole length La of junction (mm) | 70 | 70 | 70 | 70 | 70 |
| Ratio t1/t2 | 0.78 | 0.78 | 0.78 | 1.00 | 0.78 |
| Ratio t3/t2 | 0.40 | 0.40 | 0.40 | 0.51 | 0.40 |
| Ratio L/La (=ΣLi/La) | 0.50 | 0.50 | 0.29 | — | 0.21 |
| Li/La | 0.16<br>0.19<br>0.16 | 0.25<br>0.25 | 0.29 | — | 0.21 |
| Spring effect: CT value (μs) | 252 | 256 | 257 | 265 | 260 |
| Durability: Number of shots up to damage | 8900* | No damage | No damage | 5300* | 6100* |

*Generation of cracks at lower edge of face

From the results shown in Table 1, it is confirmed that the golf club heads of the Examples according to the present invention have a CT value which is suppressed to 257 μs or lower without weight increase and deterioration in durability of the face portion.

What is claimed is:

1. A hollow wood-type golf club head comprising a face portion having a face for hitting a golf ball, a sole portion constituting the bottom of the club head, and a junction interconnecting the face portion and the sole portion and including at least one thick wall portion, said at least one thick wall portion having a thickness larger than a thickness at a lower edge of the face portion and having a length L of 20 mm or more wherein the length L is a total of lengths in a toe-heel direction of said at least one thick wall portion disposed in the club head, wherein a ratio L/La of the length L of said at least one thick wall portion to a length La of said junction is from 0.10 to 0.90.

2. The golf club head of claim 1, wherein a single thick wall portion is disposed at the junction.

3. The golf club head of claim 1, wherein in a standard state that the club head is placed on a horizontal plane at prescribed lie and loft angles, said at least one thick wall portion extends across a vertical plane including the head's center of gravity and the sweet spot.

4. The golf club head of claim 1, which has a volume of 380 to 500 $cm^3$.

5. The golf club head of claim 1, which has a weight of 180 to 220 g.

6. The golf club head of claim 1, wherein said at least one thick wall portion has such a sectional shape that outer and inner surfaces of said junction are formed into arc surfaces convex toward outward of the club head, and a ratio Ri/Ro of a radius of curvature Ri of the inner surface to a radius of curvature Ro of the outer surface is from 1.2 to 20.

7. The golf club head of claim 1, wherein said at least one thick wall portion has such a sectional shape that an outer surface of said junction is an arc surface convex toward outward of the club head, and an inner surface of said junction is an inclined plane which extends from the sole portion toward a crown portion of the club head and is inclined toward the face.

8. The golf club head of claim 1, wherein said at least one thick wall portion has such a sectional shape that an outer surface of said junction is an arc surface convex toward outward of the club head, and an inner surface of said junction is an arc surface convex toward inward of the club head.

9. The golf club head of claim 1, wherein said at least one thick wall portion has a thickness t2 of 2.0 to 8.0 mm.

10. The golf club head of claim 1, wherein a thickness t1 at the lower edge of the face portion is from 1.5 to 4.5 mm.

11. The golf club head of claim 1, wherein a thickness t3 at a front edge of the sole portion is from 1.5 to 4.0 mm.

12. The golf club head of claim 1, wherein a ratio t3/t2 of a thickness t3 at a front edge of said sole portion to a thickness t2 of said at least one thick wall portion is from 0.10 to 0.90.

13. The golf club head of claim 1, wherein a plurality of thick wall portions are disposed at intervals at said junction, and a length Li of each of said thick wall portions is at least 0.10 times a whole thickness La of said junction.

14. The golf club head of claim 13, wherein the length Li of each of said thick wall portions in a toe-heel direction of the club head is at least 10 mm.

15. A hollow wood-type golf club head comprising a face portion having a face for hitting a golf ball, a sole portion constituting the bottom of the club head, and a junction interconnecting the face portion and the sole portion and including at least one thick wall portion, said at least one thick wall portion having a thickness larger than a thickness at a lower edge of the face portion and having a length L of 20 mm or more wherein the length L is a total of lengths in a toe-heel direction of said at least one thick wall portion disposed in the club head, wherein a plurality of thick wall portions are disposed at intervals at the junction.

16. A hollow wood-type golf club head comprising a face portion having a face for hitting a golf ball, a sole portion constituting the bottom of the club head, and a junction interconnecting the face portion and the sole portion and including at least one thick wall portion, said at least one thick wall portion having a thickness larger than a thickness at a lower edge of the face portion and having a length L of 20 mm or more wherein the length L is a total of lengths in a toe-heel direction of said at least one thick wall portion disposed in the club head, wherein thickness t2 of said at least one thick wall portion is larger than thickness t1 at the lower edge of the face portion by at least 0.5 mm.

17. The golf club head of claim 16, wherein a ratio t1/t2 of the thickness t1 at the lower edge of the face portion to the thickness t2 of said at least one thick wall portion is from 0.30 to 0.95.

* * * * *